US009135814B2

(12) United States Patent
Walrant et al.

(10) Patent No.: US 9,135,814 B2
(45) Date of Patent: Sep. 15, 2015

(54) REMOTE CONTROL EXTENSION WITH LIMITED COMMAND DURATION

(75) Inventors: Thierry Gilbert Claude Walrant, Leuven (BE); Koen Derom, Leuven (BE)

(73) Assignee: Home Control Singapore PTE. Ltd., Toa Payoh (SG)

( * ) Notice: Subject to any disclaimer, the term of this patent is extended or adjusted under 35 U.S.C. 154(b) by 1531 days.

(21) Appl. No.: 12/158,045

(22) PCT Filed: Dec. 12, 2006

(86) PCT No.: PCT/IB2006/054771

§ 371 (c)(1),
(2), (4) Date: Jun. 19, 2008

(87) PCT Pub. No.: WO2007/072299

PCT Pub. Date: Jun. 28, 2007

(65) Prior Publication Data

US 2008/0316046 A1 Dec. 25, 2008

(30) Foreign Application Priority Data

Dec. 22, 2005 (EP) ..... 05112797

(51) Int. Cl.
*G08C 19/16* (2006.01)
*G08C 23/04* (2006.01)
*G08C 17/02* (2006.01)

(52) U.S. Cl.
CPC ..... *G08C 23/04* (2013.01); *G08C 17/02* (2013.01); *G08C 2201/40* (2013.01); *G08C 2201/42* (2013.01)

(58) Field of Classification Search
USPC ..... 340/12.15, 12.22, 1.1, 12.1
See application file for complete search history.

(56) References Cited

U.S. PATENT DOCUMENTS

| | | | | |
|---|---|---|---|---|
| 4,850,040 | A | 7/1989 | Teich et al. | |
| 5,483,231 | A * | 1/1996 | Sasabe | 340/12.22 |
| 5,657,005 | A * | 8/1997 | Seebeck et al. | 340/12.15 |
| 6,130,625 | A * | 10/2000 | Harvey | 340/12.24 |
| 6,188,325 | B1 | 2/2001 | Vogel | |
| 6,724,339 | B2 * | 4/2004 | Conway et al. | 341/176 |
| 7,034,899 | B2 * | 4/2006 | Symoen et al. | 348/734 |
| 7,852,230 | B2 * | 12/2010 | Billo | 340/12.15 |
| 2001/0026215 | A1 * | 10/2001 | Nakaho et al. | 340/425.5 |
| 2002/0027504 | A1 * | 3/2002 | Davis et al. | 340/540 |

(Continued)

FOREIGN PATENT DOCUMENTS

| | | | |
|---|---|---|---|
| EP | 0514078 | A1 | 11/1992 |
| JP | H10136475 | A | 5/1998 |
| JP | 2005341173 | A | 12/2005 |

*Primary Examiner* — Naomi Small
(74) *Attorney, Agent, or Firm* — Hamilton, Brook, Smith & Reynolds, P.C.

(57) ABSTRACT

A remote control extension system for controlling appliances (60,70,80). A remote control (20) is connected by means of a network (30) to an extender device (40). The remote control (20) transmits messages (110,120) to the extender (40) during the period, that a command (14) is to be transmitted from the extender to an appliance. The command is for example a command having a variable duration, such as Volume UP. The extender (40) receives the messages. It transmits the command as long as it receives the messages from the remote control. It finishes the transmission of the command, if an expected message has not been received at a predetermined time. In this way, the duration of a command is limited in case of network disturbances.

24 Claims, 6 Drawing Sheets

(56) References Cited

U.S. PATENT DOCUMENTS

2003/0011467 A1* 1/2003 Suomela ..... 340/7.1
2003/0133414 A1* 7/2003 Borghs ..... 370/235
2003/0161411 A1* 8/2003 McCorkle et al. ..... 375/295
2003/0197625 A1* 10/2003 Szuba ..... 340/825.69
2004/0078116 A1* 4/2004 Hashimoto et al. ..... 700/264
2004/0108940 A1 6/2004 Witkow et al.
2004/0155809 A1 8/2004 Eyer
2006/0136610 A1* 6/2006 Lee et al. ..... 710/15

* cited by examiner

REMOTE CONTROL EXTENSION WITH LIMITED COMMAND DURATION

BACKGROUND OF THE INVENTION

1. Technical Field

The present invention relates to a system for remote control of at least an appliance, the system comprising a remote control and an extender coupled thereto. The present invention also relates to a method for remote control of at least an appliance in a system comprising a remote control and an extender coupled thereto.

2. Description of Related Art

A network infra red (IR) extender is a device specially designed to extend the coverage of a regular remote control, still using standard IR receivers for the appliances. The extender is able to reach the receiver of the appliance, for example because it is located in line of sight of the receiver, while the Remote Control (RC) is not able to reach the receiver. Remote control extender systems are particularly useful for control of hidden (e.g. built-in) devices in the same room or for control of appliances in another room. Also the combination of multiple extenders permits the control of multiple appliances at the same time without the need to move the RC around in different directions. The remote control is coupled to the extenders via a (home) network.

An existing network extender system of Philips uses a connection-based IP protocol, the Transmission Control Protocol (TCP), to communicate the commands between the RC and the extender. The remote control of this system is available under the product name TSi6400 and the extender of this system is available under the product name NXT6400. A connection-based protocol such as TCP is designed to reliably deliver the data to a peer device using acknowledgements, retransmissions and congestion control to reduce the transmission errors over congested networks. As a consequence, a connection-based protocol does not provide timely data delivery. Indeed, the protocol depends on network behavior and, if necessary, it will retransmit the same data multiple times to ensure guaranteed delivery in detriment of time constrains. In that context a RC cannot guarantee the time at which a command is delivered to an extender.

While the connection-based protocol works mostly well on a wired home network, it suffers significantly from perturbation of a wireless home network.

The requirement for time control of command execution is critical in the context of repeat commands. Repeat commands have a variable time duration. A repeat command 10 according to the state of the art is described with reference to FIG. 1. A repeat command is a special command that begins with a special start code (S), continues with continuation codes (C) and optionally finishes with an end code (E). Each code represents a single instruction for the appliance. The start code instructs the receiver of the appliance to start an operation that is maintained as long as the continuation code is sent to the receiver. Finally, the optional end code may be used to close the repeat command. Furthermore, the start code and the continuation code of the repeat command may be the same.

As an example, the user action Volume UP is executed by a repeat command. The start code requests a volume up. The volume is raised further by a predetermined dB value as long as the continuation code is received by the appliance. The receiver knows to stop incrementing volume when the continuation code is not received anymore.

The RC repeat command duration is determined by the time interval between depressing ($t_1$) and releasing a key/button ($t_2$). The duration of a repeat command is critical and must be respected, as it is the receiver of the appliance that interprets the duration in its context. For example, using a repeat command a receiver will be able to differentiate a stop ( ) action from an eject request on DVD player. A short repeat command duration meaning 'stop', while a longer repeat command duration request the DVD player to stop and open the disc tray.

The errors of repeat command duration, in particular for repeat commands executed over an IP network by a TCP connection are critical. Sometimes, the duration may be even 3 seconds longer than expected. This means that the IR extender will transmit volume UP for 3 additional seconds after the user has released the key of the remote control.

It is an object of the invention to control the duration of commands with a variable time duration in a remote control system with an extender.

SUMMARY OF THE INVENTION

This and other objects of the invention are achieved by a system according to independent claim 1, a remote control according to independent claim 12, an extender according to independent claim 13, a method according to independent claim 14, computer programs according to claims 23 and 24, a computer readable medium according to claim 25 and a carrier medium according to claim 26. Favorable embodiments are defined by the dependent claims 2-11 and 15-22.

According to the invention, remote control of at least an appliance is provided in a system comprising a remote control and an extender coupled thereto. The remote control transmits messages to the extender during the period, that a command is to be transmitted from the extender to an appliance. The extender receives the messages and transmits the command as long as it receives the messages from the remote control. It finishes the transmission of the command, if an expected message has not been received at a predetermined time. In this way, the duration of the command is limited if one of the messages is not received by the extender or if it is delayed, for example in case of perturbations on a network that is used for the transmission of the messages from the remote control to the extender.

Preferably, the remote control periodically transmits the messages and the extender finishes the transmission of the command, if no message is received within a predetermined time interval after the reception of an earlier message. In this way, the protocol for limiting the command duration is simple.

In a further preferred embodiment the extender resets a timer when receiving the messages, starts the timer and finishes the transmission of the command, if the timer reaches a predetermined time-out value without a further message being received. In this way, the extender implies the protocol according to the invention in an efficient way.

Preferably, the remote control transmits to a stop message to the extender. The extender finishes the command upon receiving the stop message. This allows finishing the command unequivocally.

Furthermore, the remote control may transmit a start message to the extender. The extender starts the transmission of the command upon receiving the start message.

In a further preferred embodiment the remote control includes an end code into the start message. The extender finishes the command by transmitting the end code. So, even if subsequent network messages are lost the extender is still able to transmit the end code, because it already receives this code with the start (first) message.

In a further preferred embodiment, the remote control includes a continuation code into the start message and the extender transmits the command using the continuation code. The extender already receives the continuation code with the start (first) message. Hereby, the risk is avoided that the continuation code does not arrive on time. Preferably, the remote control transmits at least some of the messages according to a duplication mechanism. In this way, the risk that these messages are lost is reduced.

The remote control may be a single device coupled to a network.

Alternatively, the remote control comprises a handheld device and a receiver device coupled to a network. The handheld device transmits a command to the receiver device and the receiver device, which generates the messages to be transmitted to the extender based on the command received from the handheld device.

Preferably, the invention is implemented by computer programs loaded to the remote control and the extender.

These and other aspects of the invention will be apparent from and elucidated with reference to the embodiments described hereinafter.

BRIEF DESCRIPTION OF THE DRAWINGS

The invention will be better understood and its numerous objects and advantages will become more apparent to those skilled in the art by reference to the following drawing, in conjunction with the accompanying specification, in which.

Throughout the figures like reference numerals refer to like elements.

DETAILED DESCRIPTION OF THE PRESENT INVENTION

Figure 1:
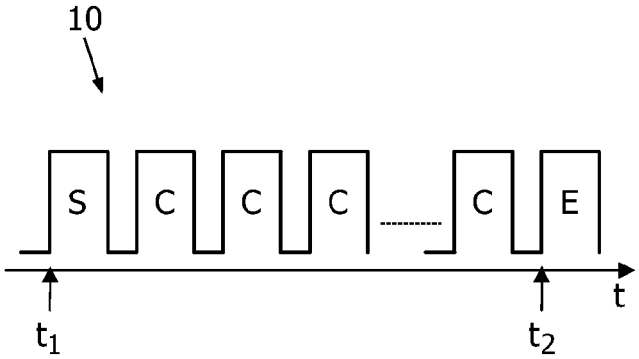
FIG. 1 shows an example of a repeat command according to the state of the art.
Figure 2:
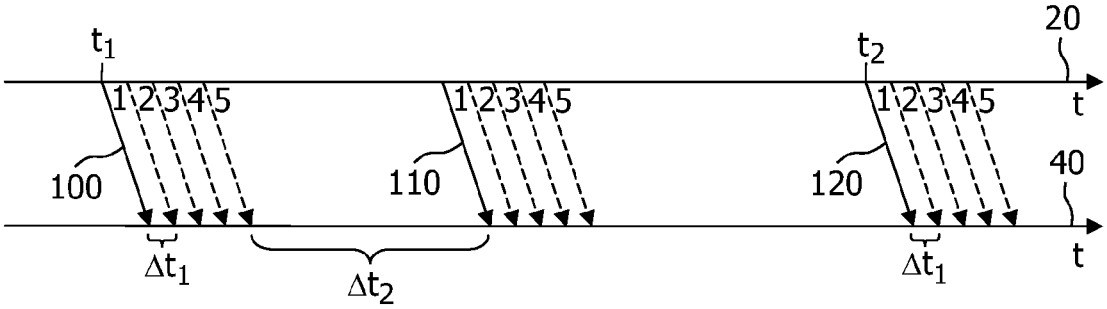
FIG. 2 shows the transmission of messages from the remote control to the extender for generating a repeat command according to an embodiment of the invention.

FIG. 2 shows the transmission of messages from a remote control 20 to an extender 40 for generating a repeat command as a function of time t. The RC repeat command duration is determined by the interval between the time of depressing $t_1$ and the time of releasing $t_2$ a key/button on the remote control. The remote control and the extender are coupled to each other by means of a network. The network may be any suitable network for remote control extension systems, such as a wireless LAN, a wired Ethernet network, a network using the power lines or a network using the in-house telephone lines. A connectionless protocol such as the User Datagram Protocol (UDP) is used for communication over the network. This network protocol provides one-way communication with the peer device. The return channel is implemented using the same protocol.

The remote control transmits three types of messages for executing the repeat command: a start message 100, an alive message 110 and a stop message 120. Using the UDP protocol each start message is transmitted a certain number of times using a duplication mechanism (5 times in FIG. 2). The duplicate transmissions are spread in time by a delay $\Delta t_1$, which provides better robustness against network interference. The next transmission of the message is most probably not affected by the interference of the previous transmission.

Upon receiving the start message the extender starts the transmission of the repeat command. The start message is followed by periodic alive messages. The alive messages are each transmitted a number of times in the same way as the start message. The alive messages are periodically sent during the live time of the repeat command. The IR extender continues transmitting the repeat command as long as it receives the alive messages. Upon receiving the stop message, the extender finishes the transmission of the repeat command. In case that the used repeat command comprises an end code, the extender finishes the repeat command by sending the end code. In the case that the used repeat command does not comprise an end code, the extender simply stops the transmission of the repeat command. In order to reduce the load on the network the alive messages are spread over time, using a certain idle time $\Delta t_2$. The IR extender expects some message after the idle time. The IR extender will automatically finish the repeat command after a time-out period without receiving any message. This time-out is derived from the idle time and the time required for sending a message. Each valid alive message arrival resets the extender time-out. Duplicate messages are ignored by the extender.

In this way a recover from failure mechanism is provided for situations in which the stop message never reaches the extender.

Selection of settings the protocol must compromise between network efficiency (i.e. not overloading the network) and introduced delays (delays happen when some of the first duplicated packets are lost).

Some values for the protocol settings are given here by way of example:

Delay $\Delta t_1$ between the duplicate messages=10 ms. This ensures a clean separation of packet on the network without large delay.

Duplication count of the messages=5. This results in a good balance between maximum delay for sending a single message [(5−1)*10 ms] and transmission robustness.

Duration of the transmission of a single message (all the duplicate packets)=[(5−1)*10 ms]=40 ms Idle time $\Delta t_2$=40 ms IR extender timeout=200 ms, equivalent to 2 continuation periods (alive message transmission time+idle time $\Delta t_2$) supplemented by one alive message transmission time. This allows the loss of one complete alive message (all the duplication packets).

The 200 ms IR extender timeout guarantees that repeat command duration will never exceed the desired time by more than 200 ms, which is acceptable for most applications. Of course, other values may be used with the same protocol.

Figure 3:
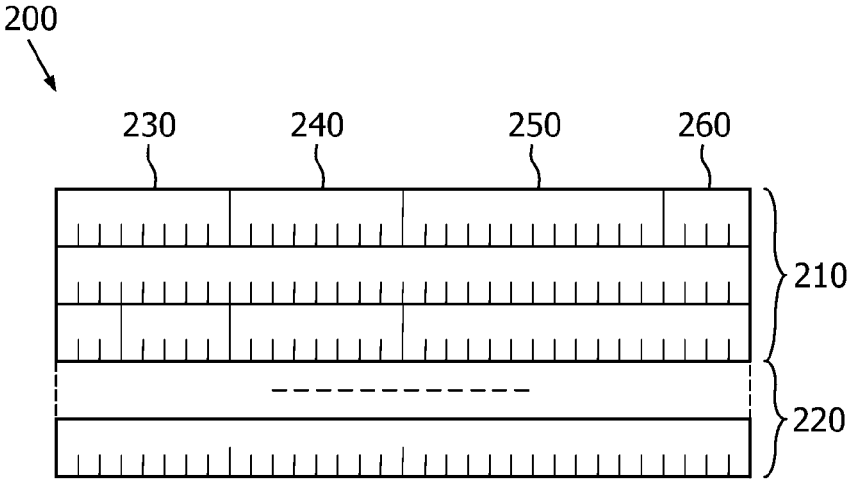
FIG. 3 shows the format of the network messages transmitted from the remote control to the extender.

FIG. 3 depicts a possible format that may be used for the network messages 200. Of course this format is given only as an example and also other formats may be used for the network messages. The network messages comprise a header 210 and a payload 220. The important fields of the header are: an extender ID field 230 for addressing the extender to which the packet is routed; a remote control ID field 240 with the ID of the remote control of origin; a message ID field 250, that uniquely identifies messages, constantly incrementing for each new message; a message counter field 260 for identifying duplicate packets for the same message.

An IR extender ignores all packets for which a packet with the same message ID has already been received.

Figure 4:
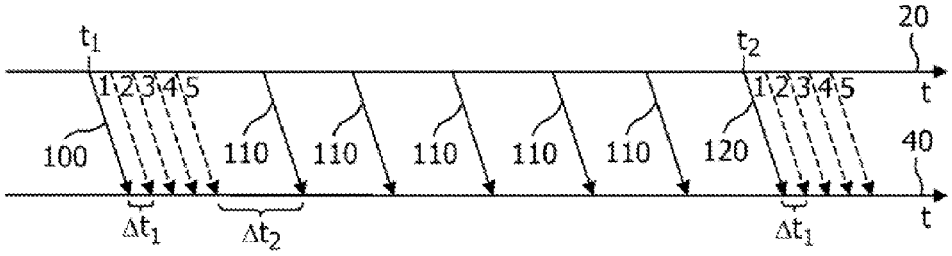
FIG. 4 shows the transmission of messages from the remote control to the extender for generating a repeat command according to an alternative embodiment of the invention.

It is to be noted that the alive messages must not necessarily follow the same duplication transmission mechanism. The purpose of the alive messages is to maintain the communication with the IR extender without specific content and without very accurate timing. FIG. 4 shows an alternative proposal, spreading more single alive messages between the start and stop messages.

Figure 5:
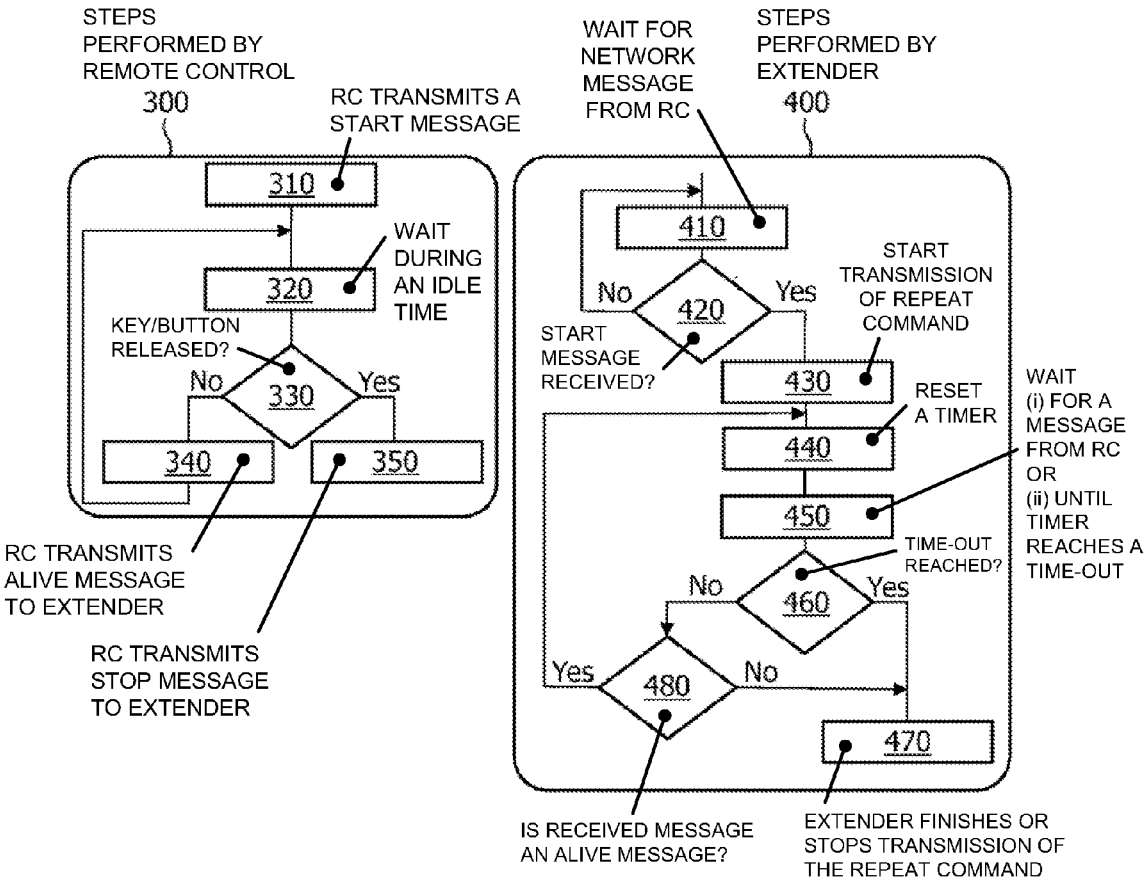
FIG. 5 shows flowcharts with the steps performed by the remote control and the extender.

In FIG. 5 flowcharts are shown with the steps performed by the remote control and the extender. The left flowchart 300 shows the steps performed by the remote control. When a key or button on the remote control is depressed the remote control transmits a start message in step 310. It then waits during an idle time if the key/button is released (step 320). If during this idle time the key/button is released (step 330), the remote control transmits a stop message to the extender (step 350). If after the idle time the key/button has not been released (step 330), it transmits an alive message to the extender (step 340) and loops back to step 320.

The right flowchart 400 shows the steps performed by the extender. In step 410 it waits for a network message from the remote control. In step 420 it checks if a start message has been received. If this is not the case it loops back to step 410. If a start message has been received, the extender starts the transmission of the repeat command in step 430. Subsequently, in step 440 it resets a timer. Subsequently, in step 450 it waits for a message from the remote control or until the timer reaches a time-out. If a time-out has been reached (step 460), it finishes the transmission of the repeat command (step 470). If no time-out has been reached but a message from the remote control is received (step 460) it checks in step 480 if this message is an alive message. If this is the case, it loops back to step 440 and resets the timer. The transmission of the repeat command is continued in this case. If the received message was not an alive message but a stop message, which is the only other possibility, the extender stops the transmission of the repeat command (step 470).

Figure 6:
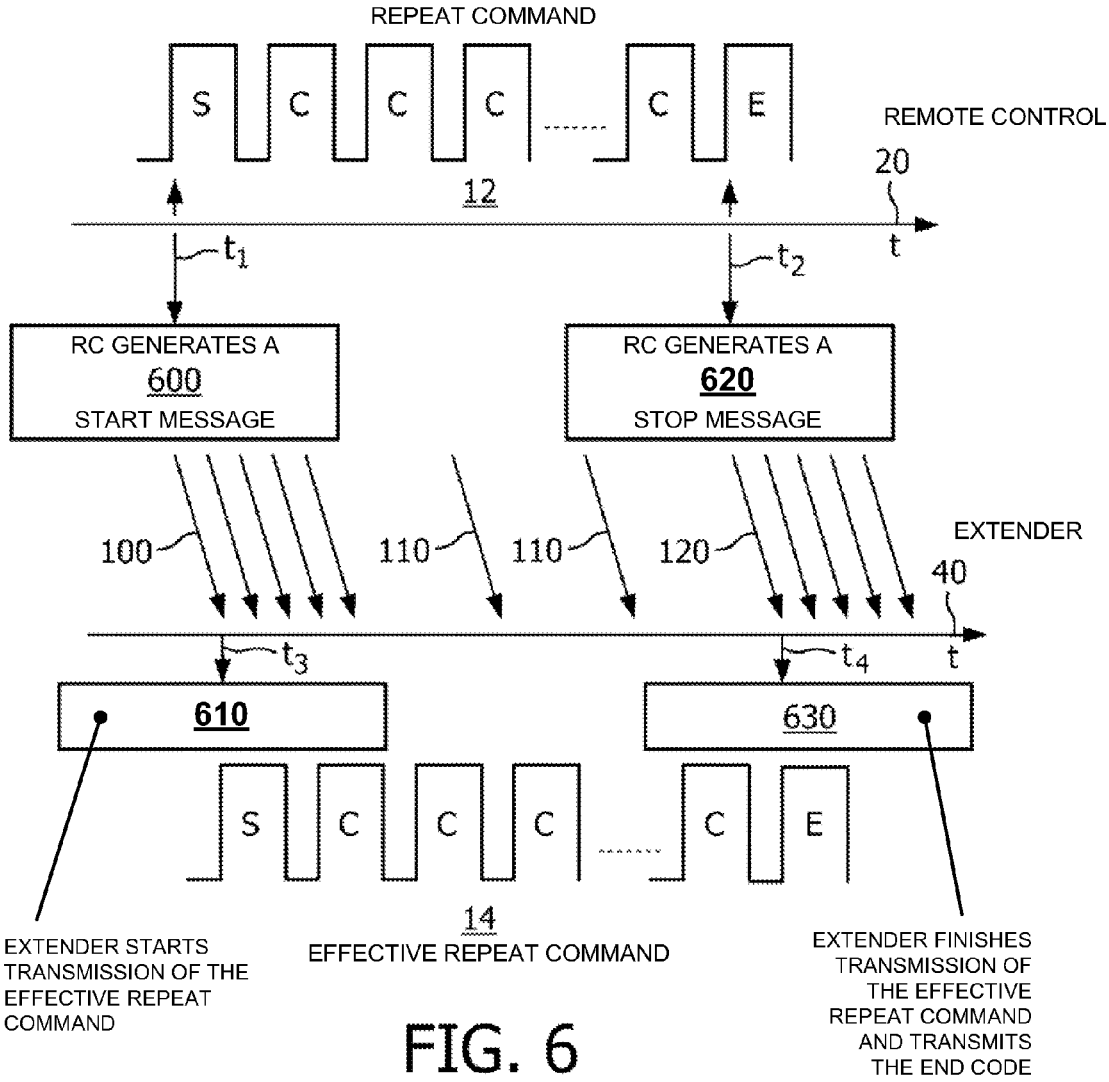
FIG. 6 shows the transmission of messages from the remote control to the extender for generating a repeat command according to a further alternative embodiment of the invention.

FIG. 6 shows the transmission of messages from the remote control to the extender for generating a repeat command according to a further alternative embodiment of the invention in case that there are no network interferences. A key is depressed on the remote control 20 from a first time $t_1$ to a second time $t_2$. The expected repeat command 12 has a duration corresponding to the time interval during which the key is pressed. When a key is depressed on the remote control at time $t_1$, the remote control generates a start message 100 comprising a complete description of the repeat command, including a start code S, a continuation code C and an end code E (step 600). This message is transmitted to the extender 40 using the duplication mechanism as already described with reference to FIGS. 2 and 4. Upon receiving the start message at time $t_3$ the extender starts the transmission of the effective repeat command 14 by sending IR codes, commencing with the start code S followed by continuation codes C (step 610). As long as alive messages 110 are received from the remote control, the extender continues the transmission of the repeat command by sending continuation codes. When the key on the remote control is released at time $t_2$, the remote control 20 generates a stop message 120 (step 620). Upon receiving the stop message at time $t_4$ the extender finishes the transmission of the repeat command (step 630). Thereto it transmits the end code. In this example all the messages of the remote control are correctly received by the extender. The duration of the effective repeat command transmitted by the extender corresponds to the duration of the expected repeat command.

Figure 7:
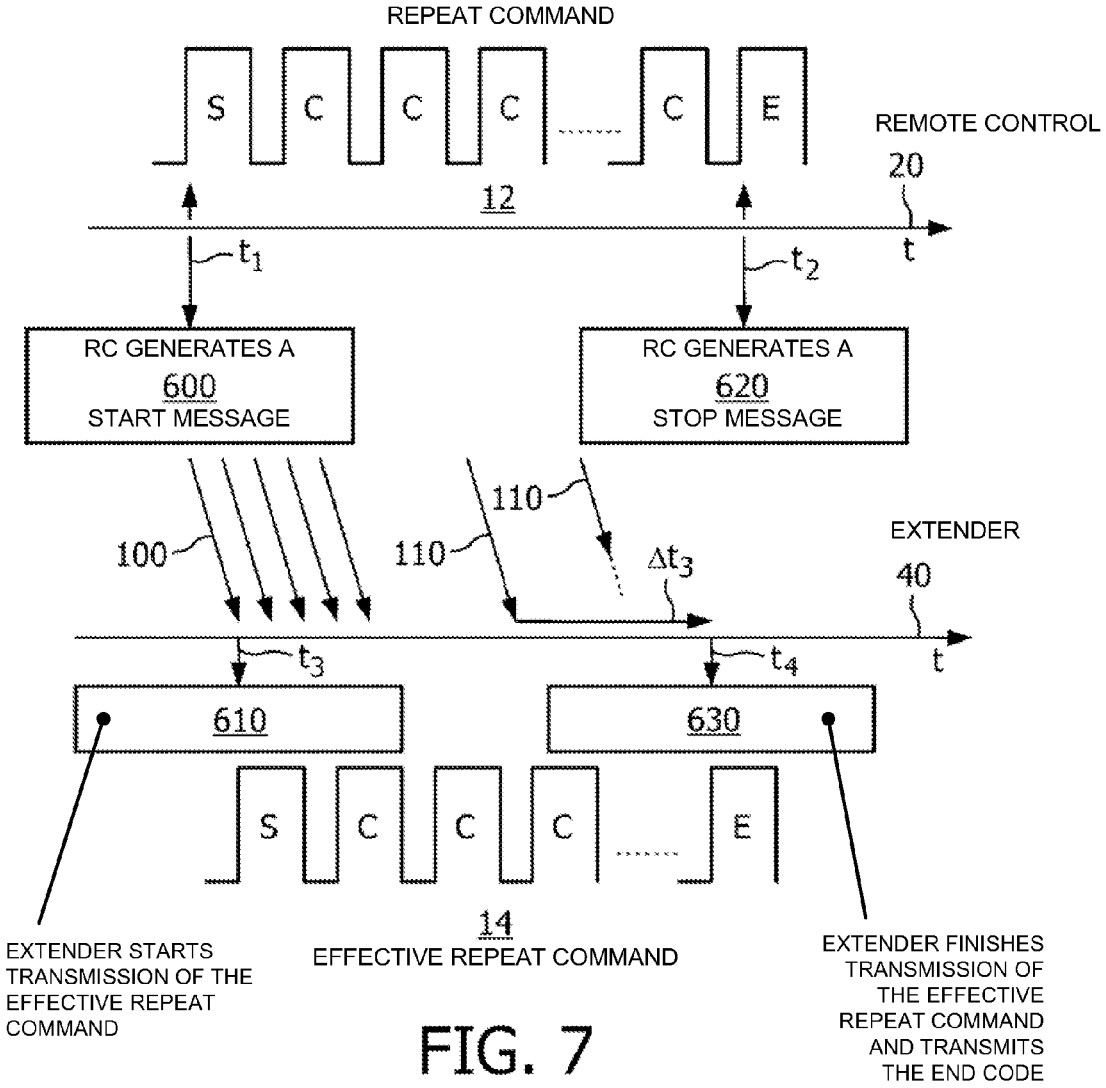
FIG. 7 shows the limitation of the duration of the repeat command in case that one of the messages transmitted by the remote control to the extender is lost.

FIG. 7 shows the relation between, the expected repeat command 12 and the effective repeat command 14 in case of network interferences resulting in the loss of a alive message. The IR codes generated by the IR extender are not similar to the expected scheme. After a predetermined time out $\Delta t_3$ without receiving any alive messages from the remote control, the extender finishes the transmission of the repeat command using the end command. So, even in case that the network is not able to deliver the stop message in time, because a packet is lost or delayed, the extender is still able to automatically terminate the repeat command with the expected end code thanks to the encapsulation of all IR codes of the repeat command into the network start message. However, the end code is generated earlier than expected.

So, as a result of the use of this time-out mechanism, the duration of the effective repeat command may be smaller than the duration of the expected repeat command in case of network interferences. Generally, this is not critical. Consider the following exemplary situation. A user has requested to eject the DVD by holding the stop/eject button for a long period. However, the repeat command is automatically stopped by the extender before the required repeat command duration for eject action, because it does not receive messages from the remote control for a certain time-out. In this case the DVD is stopped but it is not ejected. In this case the user has to repeat the operation to get the tray opened.

The invention may also be used with repeat commands that do not comprise the optional end code. In this case the start message only comprises a description of the start code and the continuation code. The extender finishes the transmission of the repeat command without transmitting any further codes, when it receives the stop message or in case of time-out.

Furthermore, the invention is also applicable for repeat commands in which the start code and the continuation code are the same.

Figure 8:
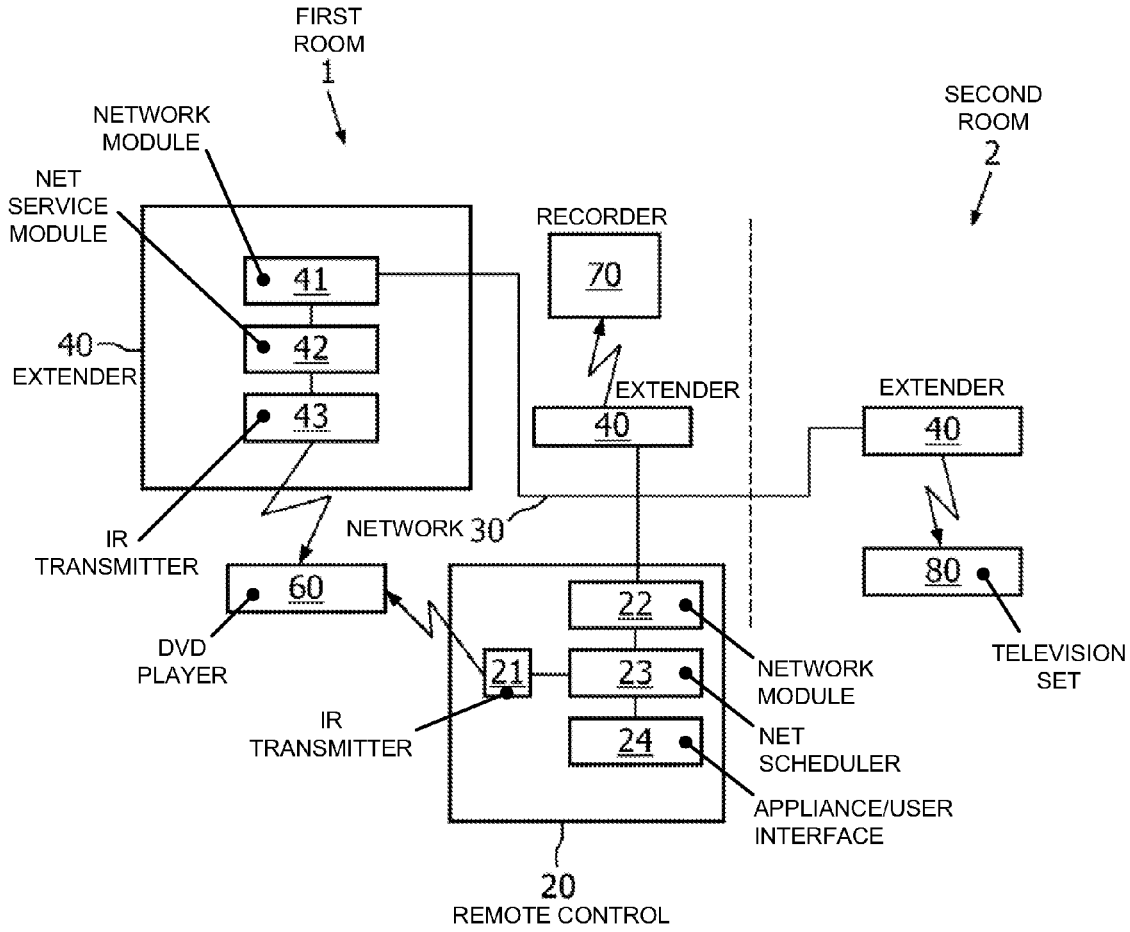
FIG. 8 shows a block diagram depicting the network architecture of a remote control network extender system according to an embodiment of the invention.

FIG. 8 shows a first network architecture of the remote control network extender system according to the invention. The system comprises a remote control 20 coupled by means of a network 30 to three similar extenders 40. Only one of the three extenders 40 is shown in detail in the figure. The network 30 is for example a home network and may be wired or wireless. Two of the extenders 40 are in a first room 1 and one is in a second room 2. The commands of the remote control 20 are transmitted over the network 30 to the extenders 40. The extenders 40 transmit the command using infra red to appliances, such as a DVD 60, a recorder 70 and a television set 80, respectively. The system is able to handle multiple appliances in a single room without moving the RC around and is also able to include an appliance in the second room into the global operations. The remote control 20 may also comprise a local transmitter 21 for directly transmitting a command to one of the appliances 60 in the first room 1. The remote control further comprises amongst others:

A network module 22 for distributing IR commands to the extender and collecting notifications and results (if any) from the extender.

A net scheduler 23 for dispatching IR commands.

An Application/User Interface 24 for providing the user-interface to execute user commands.

The network module 22 is adapted for generating the start message 100, alive messages 110 and stop messages 120, as described herein above. This functionality is preferably implemented by a processor loaded with a suitable computer program. The computer program may be embodied on a computer readable medium or may be downloaded from a server using a suitable carrier medium.

The extender 40 comprises amongst others:

A network module 41 for handling IR commands for the extender and dispatching notifications/acknowledgements, if required.

A net service module 42 for parsing, interpreting and executing commands.

An extender IR transmitter 43 for transmitting IR commands to the local appliances The net service module 42 is adapted for reading and interpreting the received messages and generating the repeat command as described herein above. This functionality is preferably implemented by a processor loaded with a suitable computer program. The computer program may be embodied on a computer readable medium or may be downloaded from a server using a suitable carrier medium.

Figure 9:
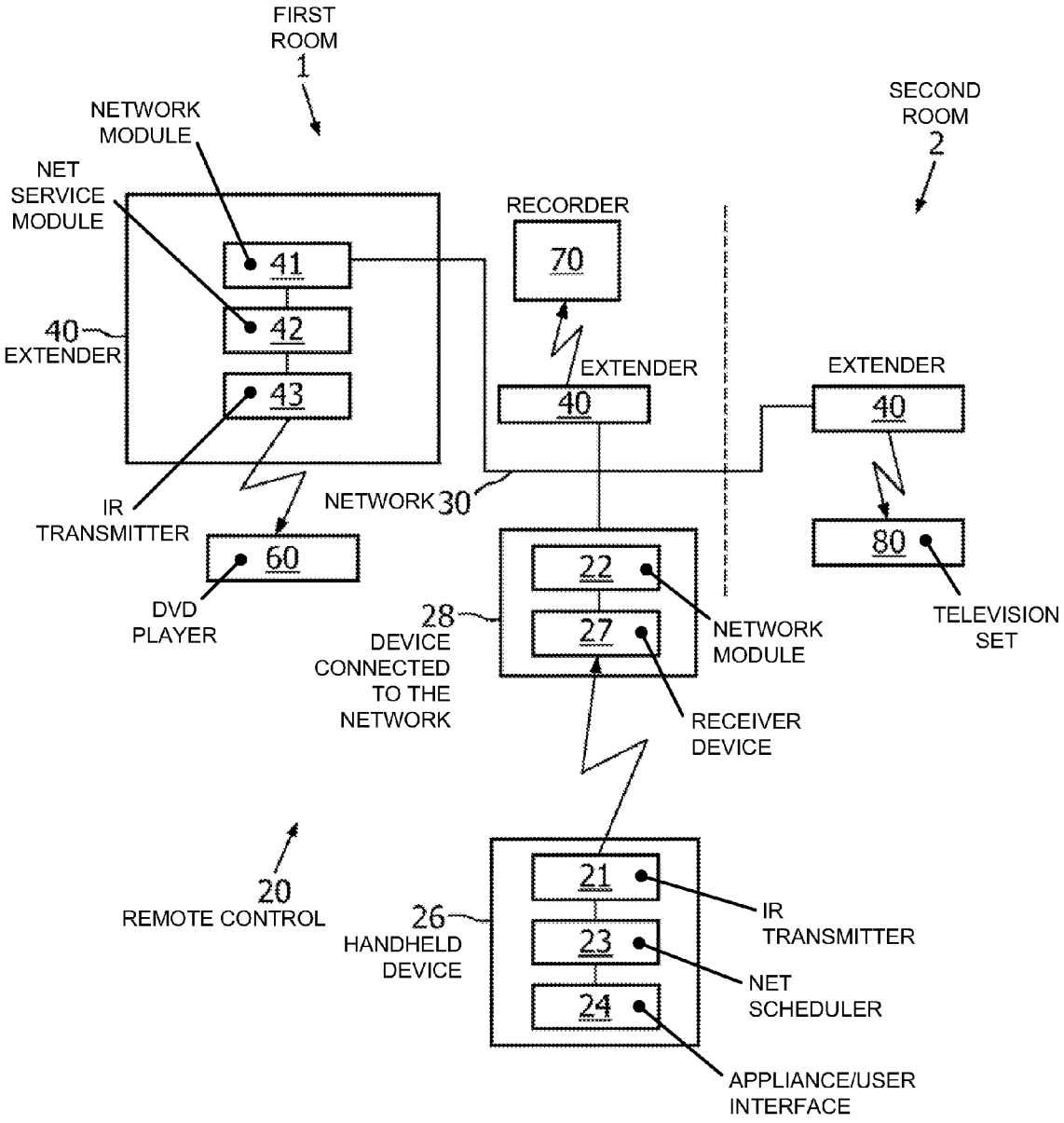
FIG. 9 shows a block diagram depicting the network architecture of a remote control network extender system according to another embodiment of the invention.

FIG. 9 shows a second network architecture of the remote control network extender system according to the invention. The remote control 20 comprises a handheld device 26 that transmits a repeat command with a certain duration to a device 28 connected to the network. The device 28 comprises a receiver device 27. The receiver device 27 forwards the command to the network module 22. The network module 22 generates the start message, alive messages and stop message and transmits them to the extenders 40 in the same way as described herein above with reference to FIG. 8.

Alternatively, the network module 22 waits until the repeat command has been received completely, before it starts the generating any messages meant for the extender. In this way, the network module 22 has information related to all the parameters of the repeat command. It then generates a single message with a completely description of the repeat command. The description comprises the start code, the continuation code and the end code as well as the delays between these codes. The network module transmits the message to one of the extenders 40. The extender 40 generates the repeat command based on this description.

As will be recognized by those skilled in the art, the innovative concepts described in the present application can be modified and varied over a wide range of applications. In the embodiments described with reference to the drawings infra red transmission is used between the extenders and the appliances but of course the invention can also be implemented in network extenders that use other transmission media like (low power) RF or ultra sound. Furthermore, the invention has been described with reference to a repeat command but of course it can also be used for other commands having a variable time duration. In the described embodiments the used network protocol is a User Datagram Protocol (UDP) but of course the invention may also be used with other network protocols. Accordingly, the scope of patented subject matter should not be limited to any of the specific exemplary teachings discussed, but is instead defined by the following claims. Any reference signs in the claims shall not be construed as limiting the scope.

The invention claimed is:

1. A system for remote control of at least an appliance, the system comprising:

a remote control device; and an extender coupled to the remote control device via a network, wherein the extender is located in a line of sight of a receiver of the appliance, while the remote control device is not in the line of sight of the receiver of the appliance, the remote control device being adapted for transmitting messages containing a description of a repeat command to the extender via the network during a period of an expected repeat command of the remote control device having a variable time duration, wherein the expected repeat command of the remote control device corresponds with an effective repeat command generated by the extender based on the description of the repeat command, wherein the effective repeat command generated by the extender is to be transmitted from the extender to the appliance;

the extender being adapted for receiving the messages transmitted from the remote control device via the network, wherein the messages include one or more of a start message, an alive message, and a stop message that describe the repeat command, for transmitting the effective repeat command to the appliance for a limited command duration as long as the extender receives the messages containing the description of the repeat command from the remote control device via the network, and for finishing the transmission of the effective repeat command to the appliance unequivocally, (i) if an expected message has not been received by the extender from the remote control device via the network within a predetermined time, wherein the expected message comprises one or more of the start message and the alive message and (ii) if one of the messages transmitted from the remote control device via the network to the extender is delayed beyond a predetermined time in case of perturbations on the network.

2. The system according to claim 1, wherein the remote control device is adapted for periodically transmitting the messages, and the extender is adapted for finishing the transmission of the effective repeat command, if no message is received within a predetermined time interval after the reception of an earlier message.

3. The system according to claim 2, wherein the extender is adapted for (i) resetting a timer in response to receiving the messages, (ii) starting the timer, and (iii) finishing the transmission of the effective repeat command, if the timer reaches a predetermined time-out value without a further message being received.

4. The system according to claim 1, wherein the remote control device is further adapted for transmitting a stop message to the extender and wherein the extender is further adapted for finishing the effective repeat command in response to receiving the stop message.

5. The system according to claim 1, wherein the remote control device is adapted for transmitting to the extender a start message and wherein the extender is further adapted for starting the transmission of the effective repeat command in response to receiving the start message.

6. The system according to claim 5, wherein the remote control device is adapted for including an end code (E) into the start message.

7. The system according to claim 6, wherein the extender is further adapted for finishing the effective repeat command by transmitting the end code to the appliance.

8. The system according to claim 5, wherein the remote control device is further adapted for including a continuation code (C) into the start message and wherein the extender is further adapted for transmitting the effective repeat command using the continuation code.

9. The system according to claim 1, wherein the remote control device is further adapted for transmitting at least some of the messages according to a duplication mechanism.

10. The system according to claim 1, wherein the remote control device is a single device coupled to a network.

11. The system according to claim 1, wherein the remote control device comprises (i) a handheld device and (ii)(a) a receiver device (ii)(b) coupled to a network, the handheld device is adapted for transmitting the expected repeat command to the receiver device and the receiver device is adapted for generating the messages to be transmitted to the extender based on the expected repeat command received from the handheld device.

12. A remote control device for use in a system for remote control of at least an appliance according to claim 1, the remote control device being adapted for transmitting messages to an extender during the period of the expected repeat command, that corresponds with the effective repeat command to be transmitted from the extender to an appliance.

13. An extender for use in a system for remote control of at least an appliance according to claim 1, the extender being adapted for receiving messages from the remote control device, wherein the messages include one or more of a start message, an alive message, and a stop message, for transmitting a effective repeat command to the appliance as long as the extender receives the messages from the remote control device, and for finishing the transmission of the effective repeat command, if an expected message has not been received within a predetermined time, wherein the expected message comprises one or more of a start message and an alive message.

14. A method for remote control of at least an appliance in a system that comprises a remote control device and an extender coupled to the remote control device via a network, wherein the extender is located in a line of sight of a receiver of the appliance, while the remote control device is not in the line of sight of the receiver of the appliance, the method comprising the steps of:

by the remote control device, transmitting messages containing a description of a repeat command to the extender via the network during a period of an expected repeat command of the remote control device having a variable time duration, wherein the expected repeat command of the remote control device corresponds with an effective repeat command generated by the extender based on the description of the repeat command, wherein the effective repeat command generated by the extender is to be transmitted from the extender to an appliance;

by the extender, receiving the messages transmitted from the remote control device via the network, wherein the messages include one or more of a start message, an alive message, and a stop message that describe the repeat command, transmitting the effective repeat command to the appliance for a limited command duration as long as the extender receives the messages containing the description of the repeat command from the remote control device via the network, and finishing the transmission of the effective repeat command to the appliance unequivocally, (i) if an expected message has not been received by the extender from the remote control device via the network within a predetermined time, wherein the expected message comprises one or more of the start message and the alive message and (ii) if one of the messages transmitted from the remote control device via the network to the extender is delayed beyond a predetermined time in case of perturbations on the network.

15. The method according to claim 14, wherein the remote control periodically transmits the messages and the extender finishes the transmission of the effective repeat command, if no message is received within a predetermined time interval after the reception of an earlier message.

16. The method according to claim 15, wherein the extender (i) resets a timer in response to receiving the messages, (ii)(a) starts the timer and (ii)(b) finishes the transmission of the effective repeat command, if the timer reaches a predetermined time-out value without a further message being received.

17. The method according to claim 14, wherein the remote control device transmits a stop message to the extender and wherein the extender finishes the effective repeat command in response to receiving the stop message.

18. The method according to claim 14, wherein the remote control device transmits a start message to the extender and wherein the extender starts the transmission of the effective repeat command in response to receiving the start message.

19. The method according to claim 18, wherein the remote control device includes an end code into the start message.

20. The method according to claim 19, wherein the extender finishes the effective repeat command by transmitting the end code to the appliance.

21. The method according to claim 18, wherein the remote control device includes a continuation code into the start message and the extender transmits the effective repeat command using the continuation code.

22. The method according to claim 14, wherein the remote control device transmits at least some of the messages according to a duplication mechanism.

23. A non-transitory computer readable medium embodied with a computer program comprising computer program code adapted to perform the following step, when said program is run on a computer:

by a remote control device transmitting messages containing a description of a repeat command to an extender via a network during a period of an expected repeat command of the remote control device having a variable time duration, wherein the expected repeat command of the remote control device corresponds with an effective repeat command generated by the extender based on the description of the repeat command, wherein the effective repeat command generated by the extender is to be transmitted from the extender to an appliance, wherein a duration of the effective repeat command is limited unequivocally at the extender (i) if an expected message is not received by the extender from the remote control device via the network and (ii) if an expected message is delayed beyond a predetermined time in case of perturbations on the network, wherein the expected message comprises one or more of a start message and an alive message.

24. A non-transitory computer readable medium embodied with a computer program comprising computer program code adapted to perform the following steps, when said program is run on a computer:

by an extender receiving messages containing a description of a repeat command transmitted from a remote control device via a network during a period of an expected repeat command of the remote control device having a variable time duration, wherein the expected repeat command of the remote control device corresponds with an effective repeat command generated by the extender based on the description of the repeat command, the effective repeat command generated by the extender for being transmitted from the extender to an appliance, wherein the messages include one or more of a start message, an alive message, and a stop message that describe the repeat command, transmitting the effective repeat command to the appliance for a limited command duration as long as the extender receives the messages containing the description of the repeat command from the remote control device via the wireless network, and finishing the transmission of the expected repeat command to the appliance unequivocally, (i) if an expected message has not been received within a predetermined time, wherein the expected message comprises one or more of the start message and the alive message and (ii) if one of the messages transmitted from the remote control device via the network to the extender is delayed beyond a predetermined time in case of perturbations on the network.

* * * * *